US008440925B2

(12) United States Patent
Chung et al.

(10) Patent No.: US 8,440,925 B2
(45) Date of Patent: May 14, 2013

(54) ENCODER WITH TRI-COLOR LED

(75) Inventors: Ching-Hao Chung, Kaohsiung (TW); Hsiu-Chen Li, Pingtung (TW); Pei-Tung Chung, Kaohsiung (TW)

(73) Assignee: Forward Electronics Co., Ltd., Taipei (TW)

( * ) Notice: Subject to any disclaimer, the term of this patent is extended or adjusted under 35 U.S.C. 154(b) by 273 days.

(21) Appl. No.: 13/064,167

(22) Filed: Mar. 9, 2011

(65) Prior Publication Data

US 2012/0175231 A1 Jul. 12, 2012

(30) Foreign Application Priority Data

Jan. 6, 2011 (TW) ..... 100200292 U

(51) Int. Cl.
*H01H 9/00* (2006.01)

(52) U.S. Cl.
USPC ..... 200/316

(58) Field of Classification Search ..... 200/37 R, 200/336, 11 R, 11 B, 11 C, 11 G, 308–317, 200/520–536
See application file for complete search history.

(56) References Cited

U.S. PATENT DOCUMENTS

| | | | | |
|---|---|---|---|---|
| 4,044,214 | A * | 8/1977 | Rayburn et al. | 200/316 |
| 5,901,835 | A * | 5/1999 | Hung | 200/316 |
| 7,205,495 | B2 * | 4/2007 | Mazur | 200/316 |
| 8,178,805 | B2 * | 5/2012 | Larson et al. | 200/316 |

* cited by examiner

*Primary Examiner* — Edwin A. Leon
(74) *Attorney, Agent, or Firm* — Bacon & Thomas, PLLC

(57) ABSTRACT

An encoder with a tri-color LED includes an insulating base, five terminals, a conductive elastic piece, a tri-color LED assembly, an encoder substrate assembly, a conductive wiper assembly, and an insulated light shaft. The five terminals and the insulating base are formed integrally. The conductive elastic piece is received in a receiving chamber of the insulating base. The tri-color LED assembly is disposed in the receiving chamber. The encoder substrate assembly covers on both the conductive elastic piece and the tri-color LED assembly. The conductive wiper assembly is received in the encoder substrate assembly. The insulated light shaft passes through a through hole of the conductive wiper assembly and a through hole of the encoder substrate assembly. Thereby, through voltage variation of an independent tri-color LED loop, color mixing can be controlled, and that to combine the same with the encoder a function of lighting and marking can be achieved.

10 Claims, 8 Drawing Sheets

ENCODER WITH TRI-COLOR LED

BACKGROUND OF THE INVENTION

1. Field of the Invention

The present invention relates to an encoder, and more particularly, to an encoder with both a tri-color LED (light emitting diode) and a pushbutton switch, adapted for electronic products such as audio or audio mixing engineering facilities, or video facilities.

2. Description of Related Art

For general electronic products such as audio or audio mixing engineering facilities, or video facilities, insulated shafts are assembled and through pushing thereof, a so-called "switch function" of switch facilities can therefore be reached.

Further, in order to strengthen function of the switch facility, an encoder is assembled thereto such that the switch facility can own both a switch function and an encoding function.

Nevertheless, in an occasion when lighting is gray such as in a movie theater or home video where lights are turned off, lighting becomes necessary for guiding purpose of the switch facility and the encoder.

Conventionally, on a substrate of the electronic product an LED is mounted for producing lighting. However, mounting the LED to the substrate has to comply with location of the encoder, making it difficult for integration of height and brightness of the LED.

Moreover, when mounting the LED an extra working step is required during manufacturing process, for example, a soldering work needs to be added for soldering the LED. This not only increases time of manufacture, but also increases cost thereof. Besides, the soldering work will adversely affect the function of the LED. Further, the LED mounted conventionally, as mentioned above, can only have one single color, but cannot change colors as required. As such, the conventional art is undesirable.

It is, therefore, significant to solve the problem and an "encoder with a tri-color LED" is accomplished after research and persistent experiments.

SUMMARY OF THE INVENTION

An object of the present invention is to provide an encoder with a tri-color LED so as to control color mixing through voltage variation of an independent red-green-blue tri-color LED loop, and to combine the same with a pushbutton switch and the encoder so as to function for lighting and marking.

Another object of the present invention is to provide an encoder with a tri-color LED such that a tri-color LED assembly, the encoder, and the pushbutton switch are integrated together and operated individually; and that terminals, after punching, are formed together with an insulating base by plastic injection molding, without the measure of welding mount, so as to avoid being easily influenced by a high-temperature manufacturing process such as a surface mounting manufacture process like the conventional art. Nor the problem of difficult integration of height and brightness of the LED will take place, let alone illumination of various color mixing, switching, and encoder can be accomplished. Accordingly, structure design and manufacturing process can be simplified so as to achieve the purpose of lightweight and compact size, and to lower the cost.

To achieve the objects, as mentioned above, the encoder with a tri-color LED, according to the present invention, comprises an insulating base, five terminals, a conductive elastic piece, the tri-color LED assembly, an encoder substrate assembly, a conductive wiper assembly, and an insulated light shaft. The insulating base has an upper surface, where the upper surface is recessed with a receiving chamber having a receiving hole. The five terminals includes a first terminal, a second terminal, a third terminal, a fourth terminal, and a fifth terminal which are not in contact with one another. The five terminals each has an insertion portion and a contact portion which are in connection with one another. The first terminal further includes an abutting portion in connection with the contact portion. The abutting portion of the first terminal and the contact portion of the third terminal are received in the receiving hole of the insulating base. The terminals each has its insertion portion extended out of the insulating base, where the five terminals and the insulating base are integrally formed.

According to the present invention, the conductive elastic piece is received in the receiving chamber of the insulating base, and is located above the abutting portion of the first terminal, and is disposed on the contact portion of the third terminal. The tri-color LED assembly is disposed in the receiving chamber of the insulating base, and has four pins in contact with the contact portions of the first, the second, the fourth, and the fifth terminals. The encoder substrate assembly covers on the insulating base, and covers on both the conductive elastic piece and the tri-color LED assembly. In addition, the encoder substrate assembly is recessed downward with a receiving chamber on which a through hole, communicated with the receiving chamber of the insulating base, is provided.

Further, according to the present invention, the conductive wiper assembly is received in the receiving chamber of the encoder substrate assembly, and is provided with a through hole communicated with the receiving chamber of the encoder substrate assembly. The insulated light shaft passes through the through hole of the conductive wiper assembly and the through hole of the encoder substrate assembly, and abuts on the tri-color LED assembly, wherein the tri-color LED assembly emits a light source penetrating through the insulated light shaft and dispersing outward.

When the insulated light shaft is pushed down so as to push the tri-color LED assembly downward, and further, the tri-color LED assembly pushes downward the conductive elastic piece, making the conductive elastic piece move downward and push the abutting portion of the first terminal. As such, the first terminal and the third terminal are electrically connected through the conductive elastic piece, and an ON switch function is then achieved. Further, when the force exerted to push down the insulated light shaft is removed, the conductive elastic piece recovers and bounds up, through its own elasticity, such that the first and the third terminals return to a non-contact state, and an OFF switch function is reached.

Still further, according to the present invention, the tri-color LED assembly, by using its four outer pins, can contact the contact portions of the first terminal, the second terminal, the fourth terminal and the fifth terminal so as to control color mixing through voltage variation of an independent loop, and to combine the same with the pushbutton switch so as to function for lighting and marking.

The tri-color LED assembly may include an insulating support base, four conductive elements, a tri-color LED chip, and a cover. The insulating support base has an upper surface recessed with a receiving chamber. The four conductive elements include a first conductive element, a second conductive element, a third conductive element, and a fourth conductive element which are not in contact with one another. The four outer pins of the tri-color assembly are each formed by a first end of the four conductive elements, respectively, whereas a second end of each of the four conductive elements is formed as a contact portion, where the contact portions are received in the receiving chamber of the insulating support base, and where the outer pins extend out of the insulating support base. The four conductive elements and the insulating support base are formed integrally. The tri-color LED chip is disposed in the receiving chamber of the insulating support base, and has four pins in contact with the contact portions of the four conductive elements respectively. Further, the cover covers on the receiving chamber of the insulating support base, and has a through hole, where the through hole is sleeved to the tri-color LED chip correspondingly.

In the present invention, the upper surface of the insulating support base may have at least one pillar, and that the cover may have at least one positioning hole corresponding to the at least one pillar such that the pillar is engaged with the positioning hole so as to position the cover on the insulating support base.

According to the present invention, the encoder with a tri-color LED may further comprise a mounting plate which covers on the conductive elastic piece, the tri-color LED assembly, the encoder substrate assembly, and the conductive wiper assembly, and which is provided with a through hole such that the insulated light shaft passes through the through hole of the mounting plate, the through hole of the conductive wiper assembly, and the through hole of the encoder substrate assembly so as to facilitate assembly and to achieve to the purpose of compact size.

According to the present invention, the encoder with a tri-color LED may further comprise an elastic plate interposed between the mounting plate and the conductive wiper assembly. Further, the mounting plate may be provided, downward, with a plurality of engaging elements which are engaged, correspondingly, at the insulating base so as to position the mounting plate on the insulating base.

The mounting plate may be provided, downward, with a plurality of pins for being inserted on a circuit board. Further, the insertion portion of each terminal of the insulating base may be perpendicular to the insulating base so as to facilitate insertion thereof on the circuit board.

Further, according to the present invention, at least one pillar may be provided at an upper surface of the encoder substrate assembly, and that the mounting plate may be provided with at least one positioning hole such that the at least one pillar is inserted into the at least one positioning hole so as to position the mounting plate on the encoder substrate assembly.

Still further, according to the present invention, the conductive elastic piece may be a circular conductive elastic piece, and that after force applied thereto has been removed, the conductive elastic piece can restore to its original position.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
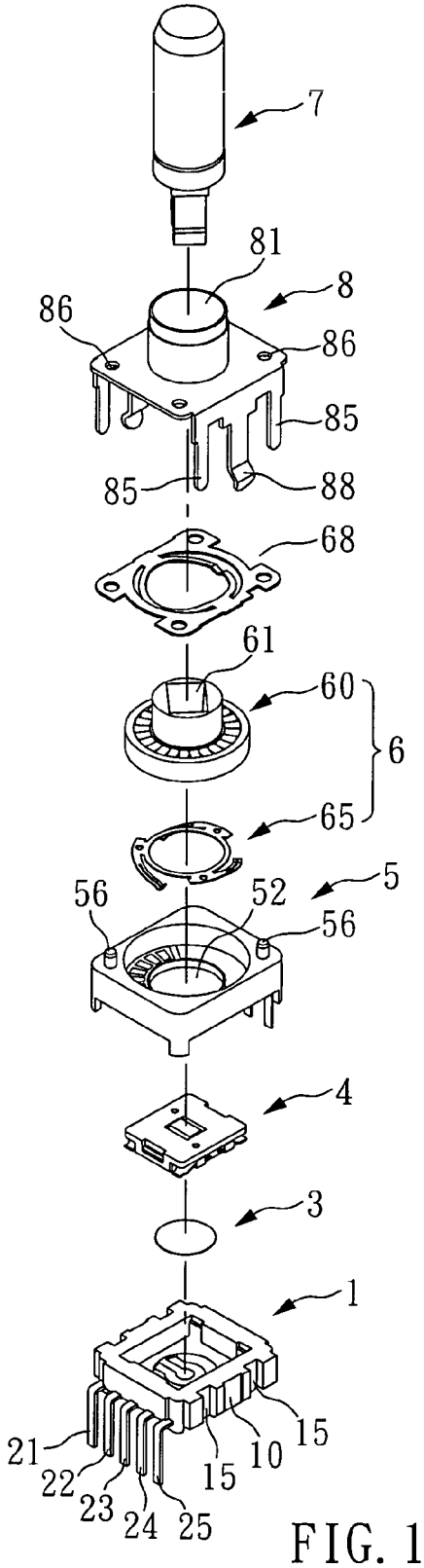
FIG. 1 is an exploded view illustrating an encoder with a tri-color LED according to the present invention.

Referring to FIG. 1, an exploded view illustrating an encoder with a tri-color LED according to the present invention, the encoder comprises an insulating base assembly 1, a conductive elastic piece 3, a tri-color LED assembly 4, an encoder substrate assembly 5, an conductive wiper assembly 6, an elastic plate 68, a mounting plate 8, and an insulated light shaft 7.

Figure 2:
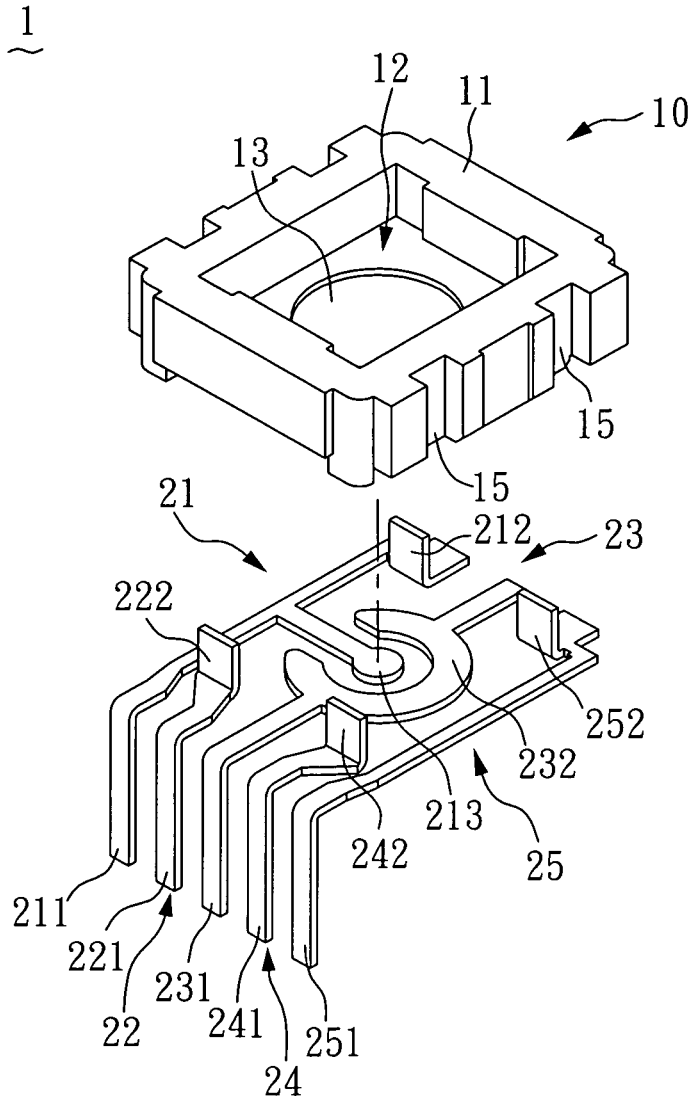
FIG. 2 is an exploded view illustrating an insulating base assembly according to the present invention.

Now referring to FIG. 2, an exploded view illustrating the insulating base assembly according to the present invention, and also to FIG. 1, the insulating base assembly 1 consists of an insulating base 10 and five terminals 21,22,23,24,25 which are formed integrally. The insulating base 10 has an upper surface 11, where the upper surface 11 is recessed with a receiving chamber 12 having a receiving hole 13.

According to the present invention, the five terminals 21,22,23,24,25 includes a first terminal 21, a second terminal 22, a third terminal 23, a fourth terminal 24, and a fifth terminal 25 which are not in contact with one another. The five terminals 21,22,23,24,25 each has an insertion portion 211,221,231,241,251 and a contact portion 212,222,232,242,252 which are in connection with one another. The first terminal 21 further includes an abutting portion 213 in connection with the contact portion 212. Namely, the first terminal 21 has the insertion portion 211, the contact portion 212, and the abutting portion 213 which are in connection with one another. The abutting portion 213 of the first terminal 21 and the contact portion 232 of the third terminal 23 are received in the receiving hole 13 of the insulating base 10. The terminals 21,22,23,24,25 each has its insertion portion 211,221,231,241,251 extended out of the insulating base 10.

As shown in FIG. 1, the conductive elastic piece 3 is received in the receiving chamber 12 of the insulating base 10, and is located above the abutting portion 213 of the first terminal 21, and is disposed on the contact portion 232 of the third terminal 23. In the present invention, the abutting portion 213 of the first terminal 21 is elongated, while the contract portion 232 of the third terminal 23 is arched, where the abutting portion 213 and the contact portion 232 are located at different levels. Besides, the conductive elastic piece 3 is a circular conductive elastic piece, and that after force applied thereto has been removed, the conductive elastic piece 3 can restore to its original position.

Figure 3:
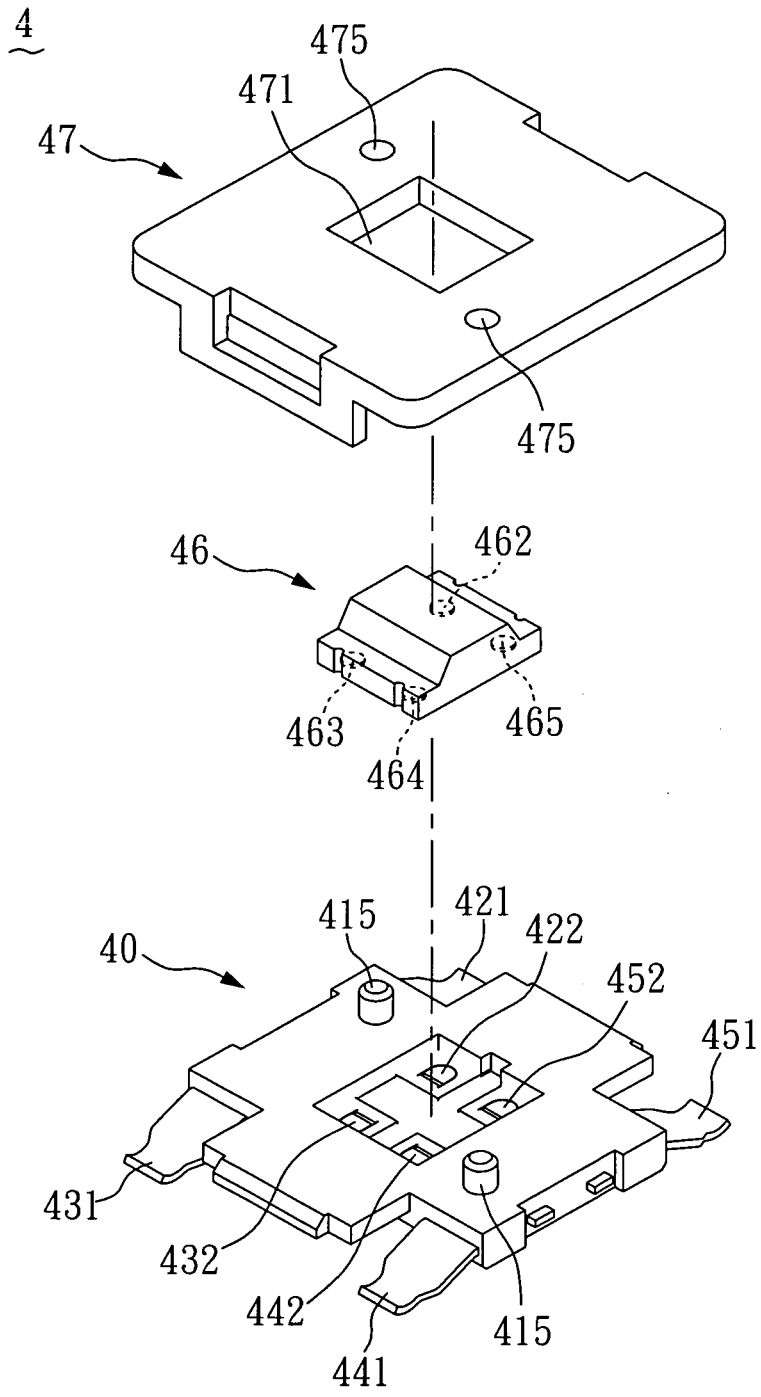
FIG. 3 is an exploded view illustrating a tri-color LED assembly according to the present invention.
Figure 4:
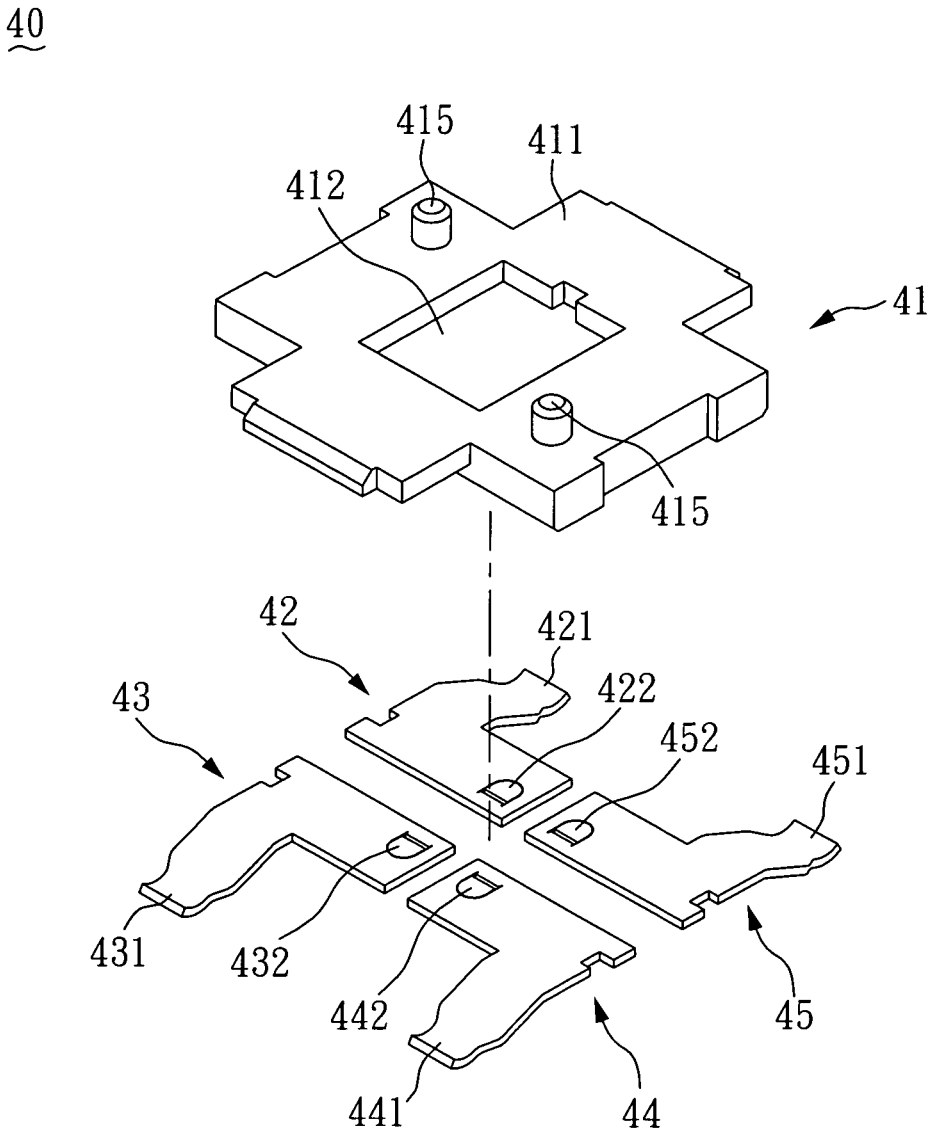
FIG. 4 is an exploded view illustrating an insulating support base assembly according to the present invention.

Further referring to FIG. 3, an exploded view illustrating the tri-color LED assembly, and to FIG. 4, an exploded view illustrating an insulating support base assembly according to the present invention, and also to FIGS. 1 and 2, the tri-color LED assembly 4 includes an insulating support base assembly 40, a tri-color LED chip 46 and a cover 47. The insulating support base assembly 40 consists of an insulating support base 41 and four conductive elements 42,43,44,45 which are formed integrally. The insulating support base 41 has an upper surface 411 recessed with a receiving chamber 412.

The four conductive elements 42,43,44,45 include a first conductive element 42, a second conductive element 43, a third conductive element 44, and a fourth conductive element 45 which are not in contact with one another. The four conductive elements 42,43,44,45 each has a first end formed as an outer pin 421,431,441,451, and each has a second end formed as a contact portion 422,432,442,452, where the contact portions 422,432,442,452 are received in the receiving chamber 412 of the insulating support base 41, while the outer pins 421,431,441,451 extend out of the insulating support base 41.

The tri-color LED chip 46 is disposed in the receiving chamber 412 of the insulating support base 41, and has four pins 462,463,464,465 in contact with the contact portions 422,432,442,452 of the four conductive elements 42,43,44,45, respectively. Further, the cover 47 covers on the receiving chamber 412 of the insulating support base 41, and has a through hole 471, where the through hole 471 is sleeved to the tri-color LED chip 46 correspondingly. In the present invention, the upper surface 411 of the insulating support base 41 has two pillars 415, and that the cover 47 has two positioning holes 475 such that the two pillars 415 are inserted into the two positioning holes 475 so as to position the cover 47 on the insulating support base 41.

As shown in the drawings, the tri-color LED assembly 4 is disposed in the receiving chamber 12 of the insulating base 10, with four outer pins 421,431,441,451 in contact with the contact portions 212,222,242,252 of the first terminal 21, the second terminal 22, the fourth terminal 24 and the fifth terminal 25.

Figure 5:
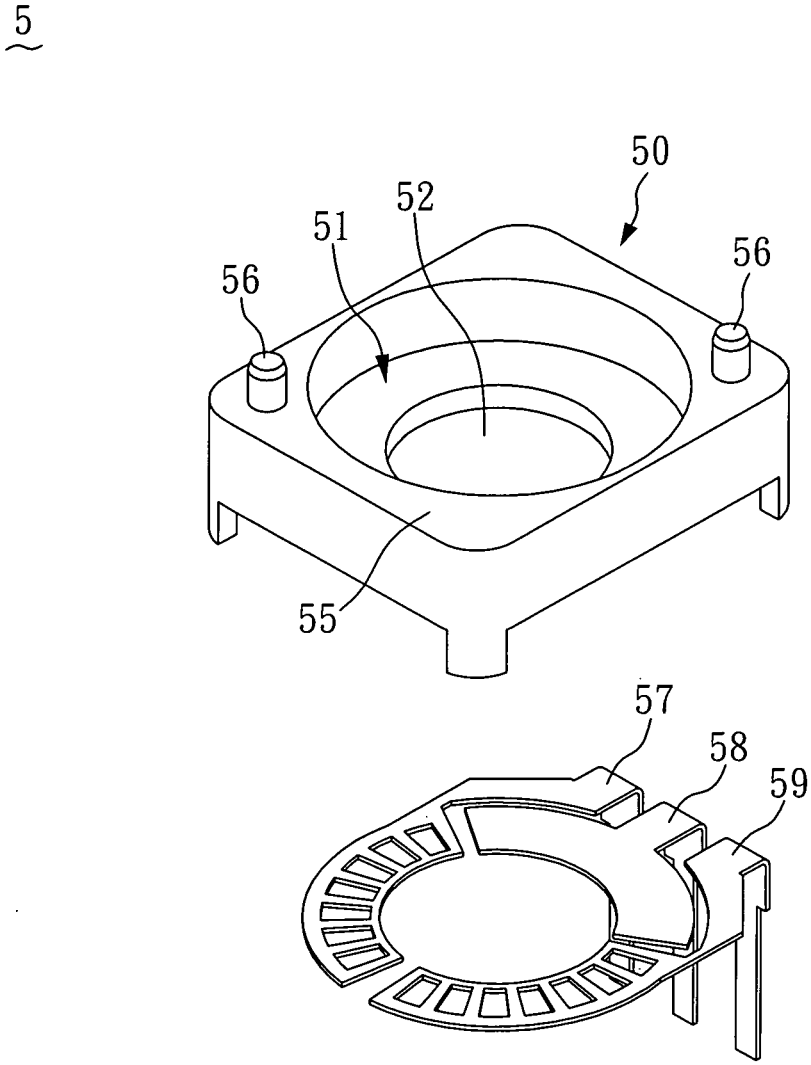
FIG. 5 is an exploded view illustrating an encoder substrate assembly according to the present invention.

Further referring to FIG. 5, an exploded view illustrating the encoder substrate assembly according to the present invention, and also to FIG. 1, the encoder substrate assembly 5 consists of an encoder substrate 50 and three encoder terminals 57,58,59 which are formed integrally. The encoder substrate assembly 5 covers on the insulating base 10, and covers on both the conductive elastic piece 3 and the tri-color LED assembly 4. In addition, the encoder substrate 50 has an upper surface 55 recessed with a receiving chamber 51 on which a through hole 52, communicated with the receiving chamber 12 of the insulating base 10, is provided. The three encoder terminals 57,58,59 include a first encoder terminal 57, a second encoder terminal 58, and a third encoder terminal 59 which are not in contact with one another.

As shown in FIGS. 1 and 5, the conductive wiper assembly 6 consists of an conductive wiper base 60 and an conductive wiper piece 65, wherein the conductive wiper assembly 6 is received in the receiving chamber 51 of the encoder substrate assembly 5, and is provided with a through hole 61 communicated with the receiving chamber 51 of the encoder substrate assembly 5.

The mounting plate 8 covers on the conductive elastic piece 3, the tri-color LED assembly 4, the encoder substrate assembly 5, and the conductive wiper assembly 6, and is provided with a through hole 81 such that the insulated light shaft 7 passes through the through hole 81 of the mounting plate 8, the through hole 61 of the conductive wiper assembly 6, and the through hole 52 of the encoder substrate assembly 5. The elastic plate 68 is interposed between the mounting plate 8 and the conductive wiper assembly 6.

The insulated light shaft 7 passes through the through hole 61 of the conductive wiper assembly 6 and the through hole 52 of the encoder substrate assembly 5, and abuts on the tri-color LED assembly 4, wherein the tri-color LED assembly 4 emits a light source penetrating through the insulated light shaft 7 and dispersing outward.

Figure 6:
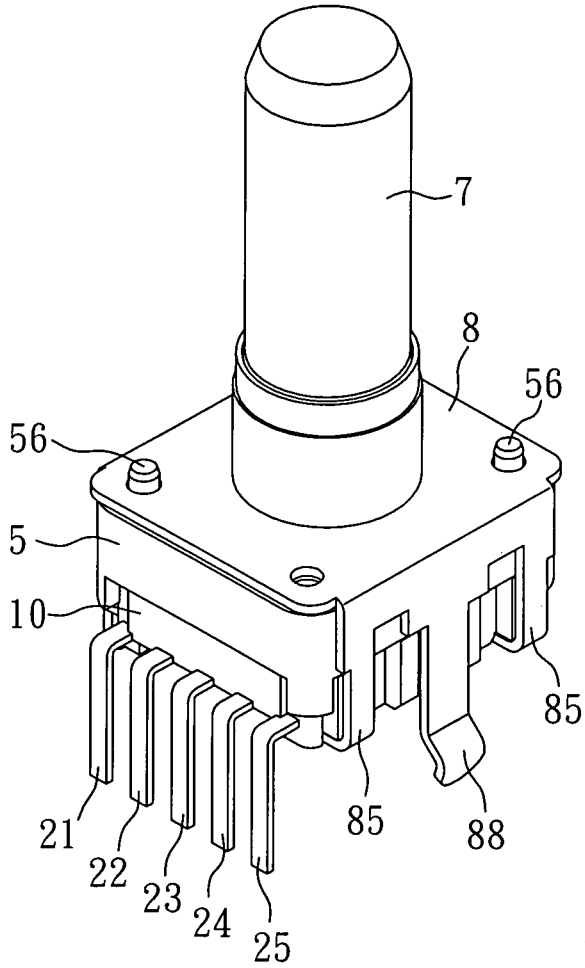
FIG. 6 is a perspective view illustrating the encoder with a tri-color LED according to the present invention.

Further referring to FIG. 6, a perspective view illustrating the encoder with a tri-color LED according to the present invention, and also to FIG. 1, the insulating base 10 is provided with two recesses 15 at two corresponding sides thereof, and that the mounting plate 8 is provided, downward, with two engaging elements 85 at two corresponding sides thereof. The engaging elements 85 can be engaged, correspondingly besides the recesses 15, at external surfaces of the insulating base 10 so as to position the mounting plate 8 on the insulating base 10, where the engaging elements 85 are bent inward after having been engaged at the external surfaces of the insulating base 10.

According to the present invention, there are two pillars 56 provided at the upper surface 55 of the encoder substrate 50, and that the mounting plate 8 is provided with two positioning holes 86 corresponding to the two pillars 56 such that the pillars 56 are inserted into the positioning holes 86, and that the mounting plate 8 can be positioned on the encoder substrate 50. Besides, the mounting plate 8 is provided, downward, with two pins 88; and that the insertion portions 211, 221,231,241,251 of the five terminals 21,22,23,24,25 of the insulating base assembly 1 are perpendicular to the insulating base 10, constituting an overall structure convenient for inserting thereof into a circuit board 9 (see FIG. 7).

Figure 7:
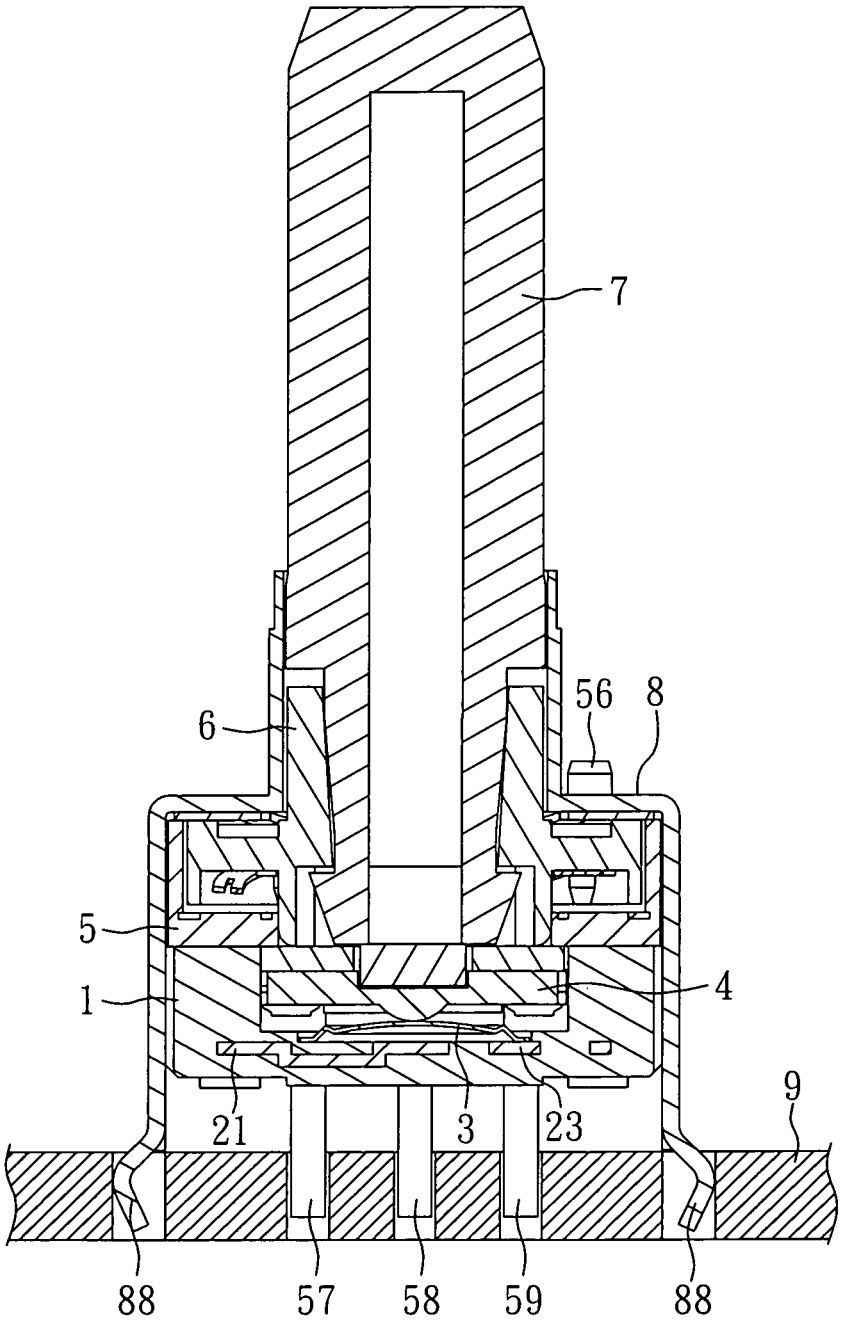
FIG. 7 is a cross-sectional view illustrating the encoder with a tri-color LED according to the present invention, where a pushbutton has not been pushed down yet.
Figure 8:
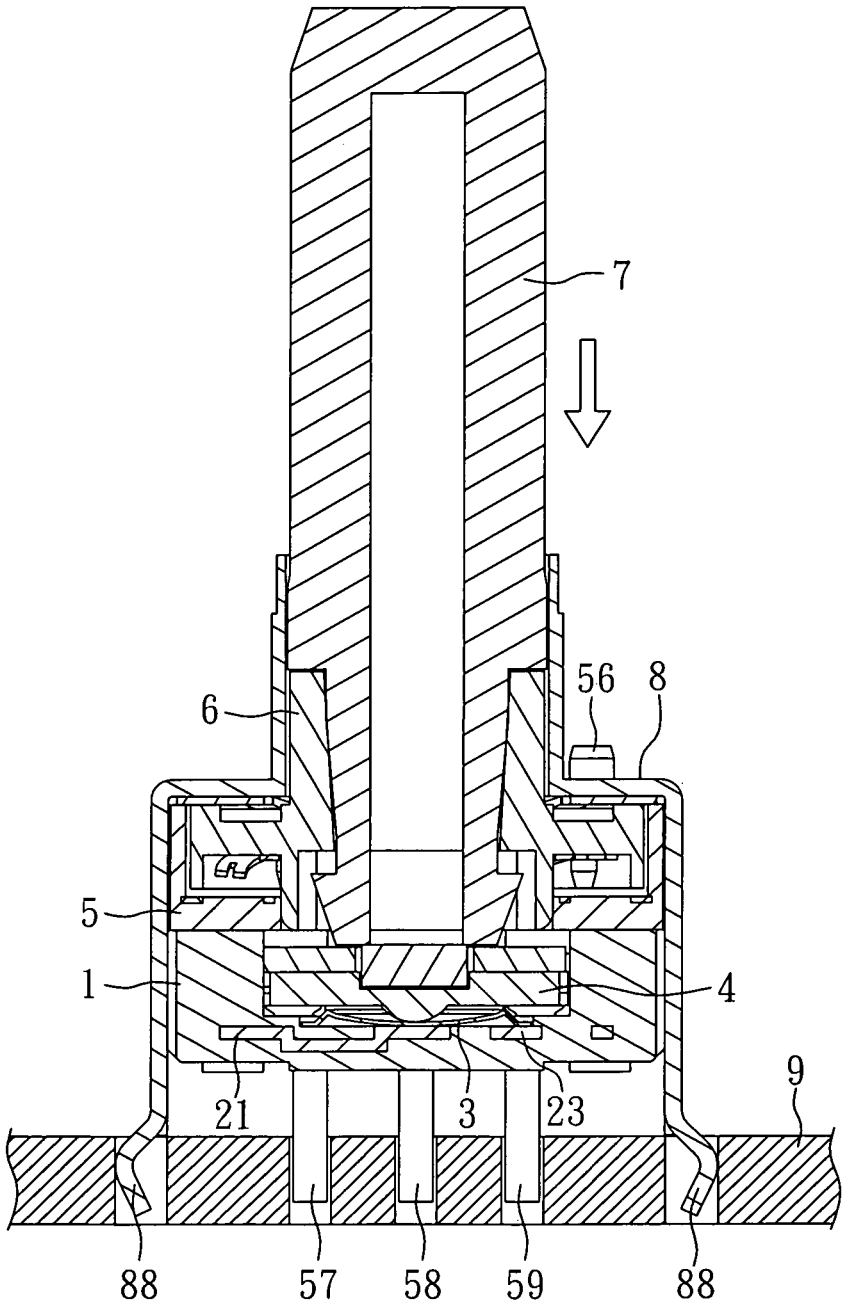
FIG. 8 is a cross-sectional view illustrating the encoder with a tri-color LED according to the present invention, where the pushbutton has been pushed down already.

Still further referring to FIG. 7, a cross-sectional view illustrating the encoder with a tri-color LED according to the present invention, where a pushbutton has not been pushed down yet, and to FIG. 8, where the pushbutton has been pushed down already, and also to FIG. 1, when the insulated light shaft 7 is pushed down so as to push the tri-color LED assembly 4 downward, and further, the tri-color LED assembly 4 pushes downward the conductive elastic piece 3, making the conductive elastic piece 3 move downward and push the abutting portion 213 of the first terminal 21. As such, the first terminal 21 and the third terminal 23 are electrically connected with each other through the conductive elastic piece 3 (see FIG. 8), and an ON switch function is then achieved. Further, when the force exerted to push down the insulated light shaft 7 is removed, the conductive elastic piece 3 recovers and bounds up, through its own elasticity, such that the first and the third terminals 21,23 return to a non-contact state (see FIG. 7), and an OFF switch function is reached.

As shown in FIGS. 1, 2, and 3, the tri-color LED assembly 4, by using its four outer pins 421,431,441,451, can contact the contact portions 212,222,242,252 of the first terminal 21, the second terminal 22, the fourth terminal 24 and the fifth terminal 25 so as to control color mixing through voltage variation of an independent loop, and to combine the same with the pushbutton switch and to function for lighting and marking. Namely, the first terminal 21, the second terminal 22, the fourth terminal 24, and the fifth terminal 25 can control color mixing, whereas the first terminal 21 and the third terminal 23 can control ON/OFF of the switch through pushing down, or not pushing down, the insulated light shaft 7.

As shown in FIGS. 1 and 5, when the insulated light shaft 7 turns to left or to right, the conductive wiper assembly 6 will make the second encoder terminal 58 of the encoder substrate assembly 5 to contact, in sequence, the first encoder terminal 57 or the third encoder terminal 59. In other words, through turning one lap of the insulated light shaft 7 for twenty-four cycles, the function of encoding can be achieved.

According to the present invention, the tri-color LED assembly 4, the conductive wiper assembly 6, and the pushbutton switch are integrated together and operated individually; and that the terminals 21,22,23,24,25, after punching, are formed together with the insulating base 10 by plastic injection molding, without the measure of welding mount, so as to avoid being easily influenced by a high-temperature manufacturing process such as a surface mounting manufacture process as the conventional art. Nor the problem of difficult integration of height and brightness of the LED will take place, let alone functions such as illumination of various color mixing, switching, and encoder can be achieved. According to the present invention, structure design and manufacturing process can be simplified so as to achieve the purpose of lightweight and compact size, and to lower the cost.

Although the present invention has been explained in relation to its preferred embodiments, it is to be understood that many other possible modifications and variations can be made without departing from the scope of the invention as hereinafter claimed.

What is claimed is:

1. An encoder with a tri-color LED, comprising:

an insulating base, having an upper surface, wherein the upper surface is recessed with a receiving chamber having a receiving hole;

five terminals, including a first terminal, a second terminal, a third terminal, a fourth terminal, and a fifth terminal which are not in contact with one another, wherein the five terminals each has an insertion portion and a contact portion which are in connection with one another, and the first terminal further includes an abutting portion in connection with the contact portion, and the abutting portion of the first terminal and the contact portion of the third terminal are received in the receiving hole of the insulating base, and the terminals each has its insertion portion extended out of the insulating base, where the five terminals and the insulating base are formed integrally;

a conductive elastic piece, being received in the receiving chamber of the insulating base, and being located above the abutting portion of the first terminal, and being disposed on the contact portion of the third terminal;

a tri-color LED assembly, being disposed in the receiving chamber of the insulating base, and having four outer pins in contact with the contact portions of the first, the second, the fourth, and the fifth terminals;

an encoder substrate assembly, covering on the insulating base, and covering on both the conductive elastic piece and the tri-color LED assembly, wherein the encoder substrate assembly is recessed downward with a receiving chamber on which a through hole is provided;

an conductive wiper assembly, being received in the receiving chamber of the encoder substrate assembly, and being provided with a through hole; and an insulated light shaft, passing through the through hole of the encoder and the through hole of the encoder substrate assembly, and abutting on the tri-color LED assembly.

2. The encoder with a tri-color LED as claimed in claim 1, wherein the tri-color LED assembly includes an insulating support base, four conductive elements, a tri-color LED chip, and a cover; and wherein the insulating support base has an upper surface recessed with a receiving chamber, and the four conductive elements include a first conductive element, a second conductive element, a third conductive element, and a fourth conductive element which are not in contact with one another, and the four outer pins of the tri-color assembly are each formed by a first end of the four conductive elements, respectively, whereas a second end of each of the four conductive elements is formed as a contact portion, and the contact portions are received in the receiving chamber of the insulating support base, and the outer pins extend out of the insulating support base such that the four conductive elements and the insulating support base are formed integrally; and wherein the tri-color LED chip is disposed in the receiving chamber of the insulating support base, and has four pins in contact with the contact portions of the four conductive elements respectively; and wherein the cover covers on the receiving chamber of the insulating support base, and has a through hole sleeved to the tri-color LED chip correspondingly.

3. The encoder with a tri-color LED as claimed in claim 2, wherein the upper surface of the insulating support base has at least one pillar, and the cover has at least one positioning hole such that the pillar is inserted into the positioning hole.

4. The encoder with a tri-color LED as claimed in claim 1, further comprising a mounting plate which covers on the conductive elastic piece, the tri-color LED assembly, the encoder substrate assembly, and the conductive wiper assembly; and which is provided with a through hole such that the insulated light shaft passes through the through hole of the mounting plate, the through hole of the conductive wiper assembly, and the through hole of the encoder substrate assembly.

5. The encoder with a tri-color LED as claimed in claim 4, further comprising an elastic plate interposed between the mounting plate and the conductive wiper assembly.

6. The encoder with a tri-color LED as claimed in claim 4, wherein the mounting plate is provided, downward, with a plurality of engaging elements which are engaged at the insulating base.

7. The encoder with a tri-color LED as claimed in claim 4, wherein the mounting plate is provided, downward, with a plurality of pins for being inserted on a circuit board.

8. The encoder with a tri-color LED as claimed in claim 4, wherein there is at least one pillar provided at an upper surface of the encoder substrate assembly, and the mounting plate is provided with at least one positioning hole such that the at least one pillar is inserted into the at least one positioning hole.

9. The encoder with a tri-color LED as claimed in claim 1, wherein the conductive elastic piece is a circular conductive elastic piece.

10. The encoder with a tri-color LED as claimed in claim 1, wherein the insertion portion of each terminal of the insulating base is perpendicular to the insulating base.

* * * * *